US011291339B2

(12) United States Patent
Dorman et al.

(10) Patent No.: US 11,291,339 B2
(45) Date of Patent: Apr. 5, 2022

(54) MODULAR VACUUM SYSTEM

(71) Applicant: MILWAUKEE ELECTRIC TOOL CORPORATION, Brookfield, WI (US)

(72) Inventors: Justin D. Dorman, Wauwatosa, WI (US); Jason R. Crowe, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 205 days.

(21) Appl. No.: 16/426,068

(22) Filed: May 30, 2019

(65) Prior Publication Data

US 2019/0365168 A1 Dec. 5, 2019

Related U.S. Application Data

(60) Provisional application No. 62/680,134, filed on Jun. 4, 2018.

(51) Int. Cl.

| | |
|---|---|
| ***A47L 5/36*** | (2006.01) |
| ***A47L 9/00*** | (2006.01) |
| ***A47L 9/22*** | (2006.01) |

(52) U.S. Cl.

CPC ..... *A47L 5/365* (2013.01); *A47L 9/009* (2013.01); *A47L 9/22* (2013.01)

(58) Field of Classification Search

CPC ..... A47L 5/36; A47L 5/22; A47L 5/00; A47L 5/12; A47L 5/365; A47L 7/0095; A47L 7/02; A47L 7/0004; A47L 7/0009; A47L 7/0019; A47L 7/0023; A47L 7/0038; A47L 7/0076; A47L 7/00; A47L 9/00; A47L 9/009; A47L 9/16; A47L 9/1683;

(Continued)

(56) References Cited

U.S. PATENT DOCUMENTS 2,046,675 A * 7/1936 Daiger ..... H02K 23/66 310/73

2,863,524 A 12/1958 Buda (Continued)

FOREIGN PATENT DOCUMENTS

CN 102711577 A 10/2012
CN 104068789 A 10/2014

(Continued)

OTHER PUBLICATIONS

International Search Report and Written Opinion for Application No. PCT/US2019/034495 dated Sep. 20, 2019 (14 pages).

(Continued)

*Primary Examiner* — Joseph J Hail

*Assistant Examiner* — Jonathan R Zaworski

(74) *Attorney, Agent, or Firm* — Michael Best & Friedrich LLP

(57) ABSTRACT

A modular vacuum system includes a first and second canister of different capacities that are configured to store debris. The modular vacuum system also includes first and second power heads that can be coupled to either the first or second canisters. The first and second power heads operate at different voltages that generate a first and second suction airflow. The first and second canisters store debris separated from the first and second suction airflow. The first and second canisters also store debris separated only from the first suction airflow.

20 Claims, 5 Drawing Sheets

(58) Field of Classification Search
CPC ..... A47L 9/22; A47L 9/2868; A47L 9/2878; A47L 9/2884; A47L 11/4013
USPC ..... 15/300.1, 327.1, 327.6, 330, 331, 334, 15/352, 353, 412
See application file for complete search history.

(56) References Cited

U.S. PATENT DOCUMENTS

| | | | | |
|---|---|---|---|---|
| 4,222,145 | A | 9/1980 | Lowder | |
| 4,654,926 | A | 4/1987 | McCambridge | |
| 4,845,793 | A * | 7/1989 | Meyer | A47L 5/225 15/328 |
| 7,143,469 | B2 | 12/2006 | Moine et al. | |
| 8,074,321 | B2 * | 12/2011 | Fry | A47L 7/0038 15/328 |
| 8,667,640 | B2 | 3/2014 | Conrad | |
| 8,689,983 | B1 | 4/2014 | Ripley | |
| 9,854,955 | B2 * | 1/2018 | Richter | A47L 11/4083 |
| 10,791,889 | B2 * | 10/2020 | Conrad | A47L 5/225 |
| 2005/0257340 | A1 | 11/2005 | Parrott | |
| 2007/0113369 | A1 | 5/2007 | Cochran et al. | |
| 2010/0071151 | A1 | 3/2010 | Crevling, Jr. et al. | |
| 2016/0235266 | A1 * | 8/2016 | Tomasiak | A47L 5/365 |
| 2017/0303754 | A1 * | 10/2017 | Conrad | A47L 5/28 |
| 2018/0078104 | A1 * | 3/2018 | Register | A47L 5/365 |

FOREIGN PATENT DOCUMENTS

| | | | |
|---|---|---|---|
| CN | 107837038 | A1 | 3/2018 |
| CN | 207545020 | U | 6/2018 |
| DE | 2227935 | A1 | 12/1973 |
| DE | 4004177 | A1 | 8/1991 |
| EP | 3223672 | A1 | 10/2017 |
| EP | 3295853 | A1 | 3/2018 |
| JP | H08-303394 | A | 11/1996 |
| JP | 2012-217782 | A | 11/2012 |
| KR | 10-1606890 | B1 | 3/2016 |
| WO | 9835600 | A1 | 8/1998 |
| WO | 2008070974 | A1 | 6/2008 |
| WO | 2016054457 | A1 | 4/2016 |

OTHER PUBLICATIONS

Chinese Patent Office Action for Application No. 201980036038.5 dated Nov. 18, 2021 (12 pages including statement of relevance).

* cited by examiner

MODULAR VACUUM SYSTEM

CROSS-REFERENCE TO RELATED APPLICATIONS

This application claims priority to U.S. Provisional Patent Application No. 62/680,134 filed on Jun. 4, 2018, the entire contents of which are incorporated herein by reference.

BACKGROUND

The present invention relates to vacuum cleaners.

Vacuum cleaners may include a power head including a fan and a motor for generating a suction airflow. The suction airflow supplied by the vacuum cleaner is often used for collecting debris and depositing the debris in a collector or compartment. These collectors are often removable from the power head to empty the collector

SUMMARY

In one embodiment, the invention provides a modular vacuum system including a first canister with a first capacity configured to store debris, a second canister with a second capacity greater than the first capacity, a first power head and a second power head. The first power head is coupled to either the first canister or the second canister. The first power head is operable at a first voltage to generate a first suction airflow, and the first power head can be coupled to the first canister such that the first canister receives the first suction airflow. The first canister stores debris separated from the first suction airflow. The first power head can be coupled to the second canister such that the second canister receives the first suction airflow. The second canister stores debris separated from the first suction airflow. The second power head can be coupled to either the first canister or the second canister. The second power head is operable at a second voltage, greater than the first voltage, to generate a second suction airflow, and the second power head can be coupled to the first canister such that the first canister receives the second suction airflow. The first canister stores debris separated from the second suction airflow. The second power head can be coupled to the second canister such that the second canister receives the second suction airflow. The second canister stores debris separated from the second suction airflow.

In another embodiment, the invention provides a modular vacuum system including a first canister with a first capacity configured to store debris, a second canister with a second capacity greater than the first capacity, and a power head that can be coupled to either the first canister or the second canister. The power head is operable to generate a suction airflow. The power head can be coupled to the first canister such that the first canister receives the suction airflow and the first canister stores debris separated from the suction airflow. The power head can be coupled to the second canister having a greater capacity than the first canister such that the second canister receives the suction airflow and the second canister stores debris separated from the suction airflow.

Other aspects of the invention will become apparent by consideration of the detailed description and accompanying drawings.

DETAILED DESCRIPTION

Figure 1:
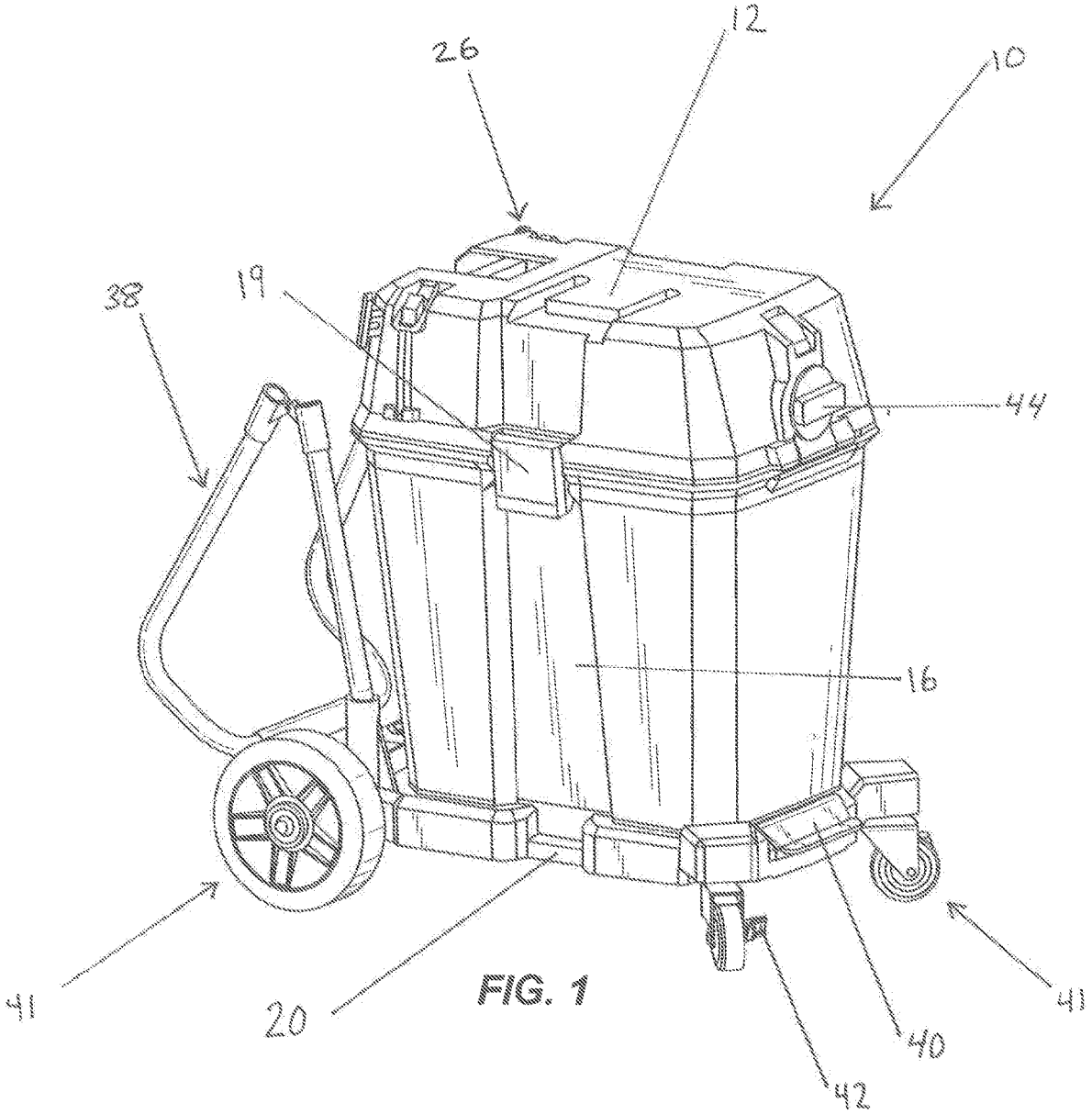
FIG. 1 is a perspective view of the modular vacuum system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-5 illustrate a modular vacuum system 10. The modular vacuum system 10 includes a first power head 12, a second power head 14, a first canister 16, a second canister 17, a third canister 18 and a base 20. The power heads 12, 14 can be connected to canisters 16, 17, 18 by using a latch 19, and the canisters 16, 17, 18 can be connected to the base 20. The latch 19 can be actuated to lock or release the power heads 12, 14 to the canisters 16, 17, 18. The power heads 12, 14 have different performance levels and the canisters 16, 17, 18 have different capacities. Therefore, the user can select the power head performance, the canister size, and the base 20 for a modular and custom design to fit the user's needs.

Figure 5:
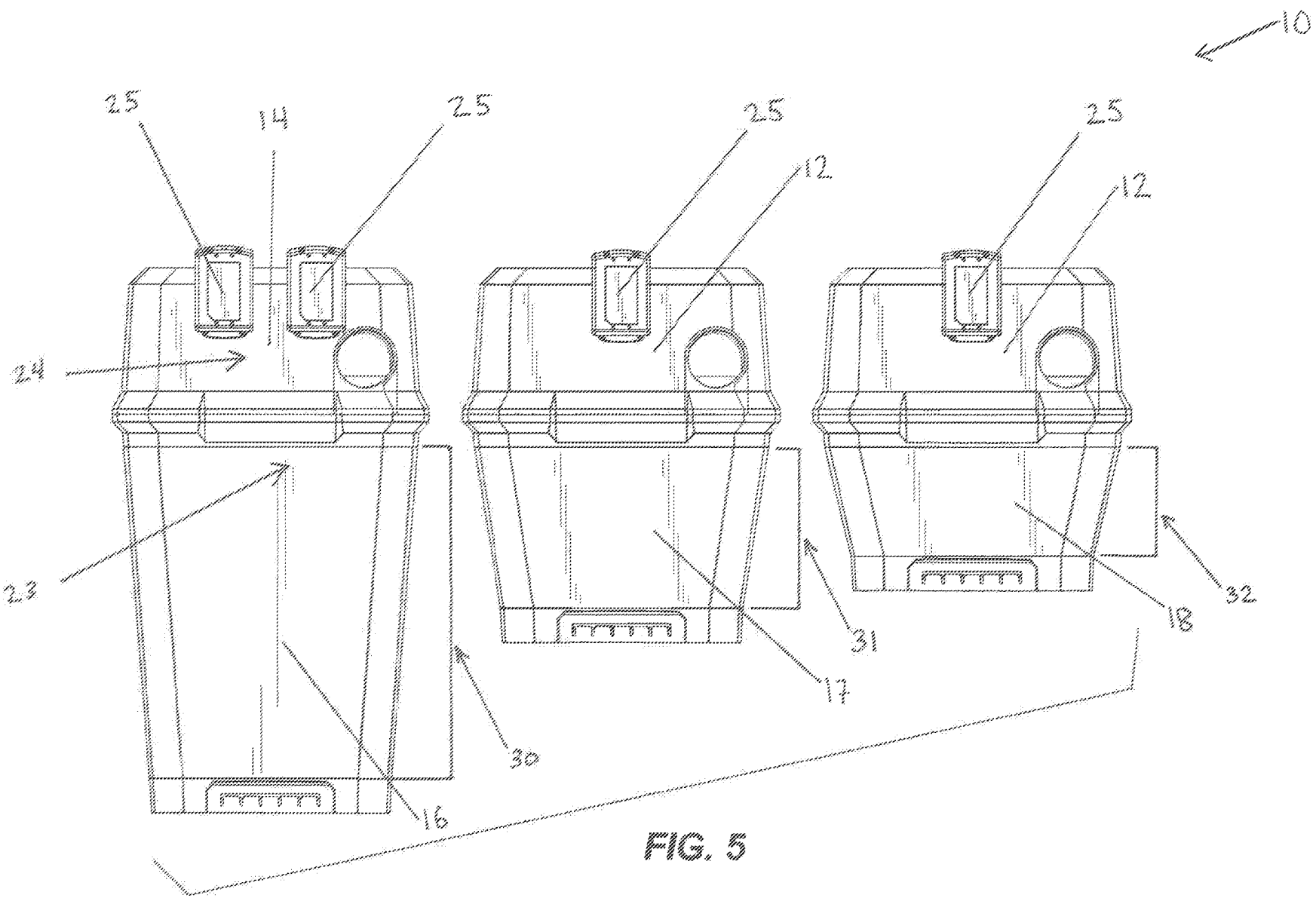
FIG. 5 illustrates a variety of canister paired with a variety of power heads.

FIG. 5 illustrates the first power head 12 and the second power head 14. The first power head 12 has a first performance level and includes a first fan 21 and a first motor 22. The second power head 14 has a second performance level generally exceeding the first performance level and includes a second fan 23 and a second motor 24. The first performance level has a first voltage and the second performance level has a second voltage greater than the first voltage. The first voltage is provided by an 18 volt lithium-ion battery 25. The second voltage is provided by two of the 18 volt lithium-ion batteries 25 that create a 36 volt system. In other embodiments, different battery voltages can be used. In another embodiment, the power heads 12, 14 include an AC power input 26 to charge the 18 volt lithium-ion battery 25, and/or to power the power heads 12, 14 when the 18 volt lithium-ion battery 25 is not used. In yet another embodiment, the power heads 12, 14 may be only powered by the AC power input 26. The power heads 12, 14 may include a horizontal filter. The filter is interchangeable for various purposes—wet, dust, HEPA, etc. In one embodiment, the filter includes a visual indicator on the side of the filter so the user knows what type of filter wet, dust, HEPA, etc.) is installed.

Figure 4:
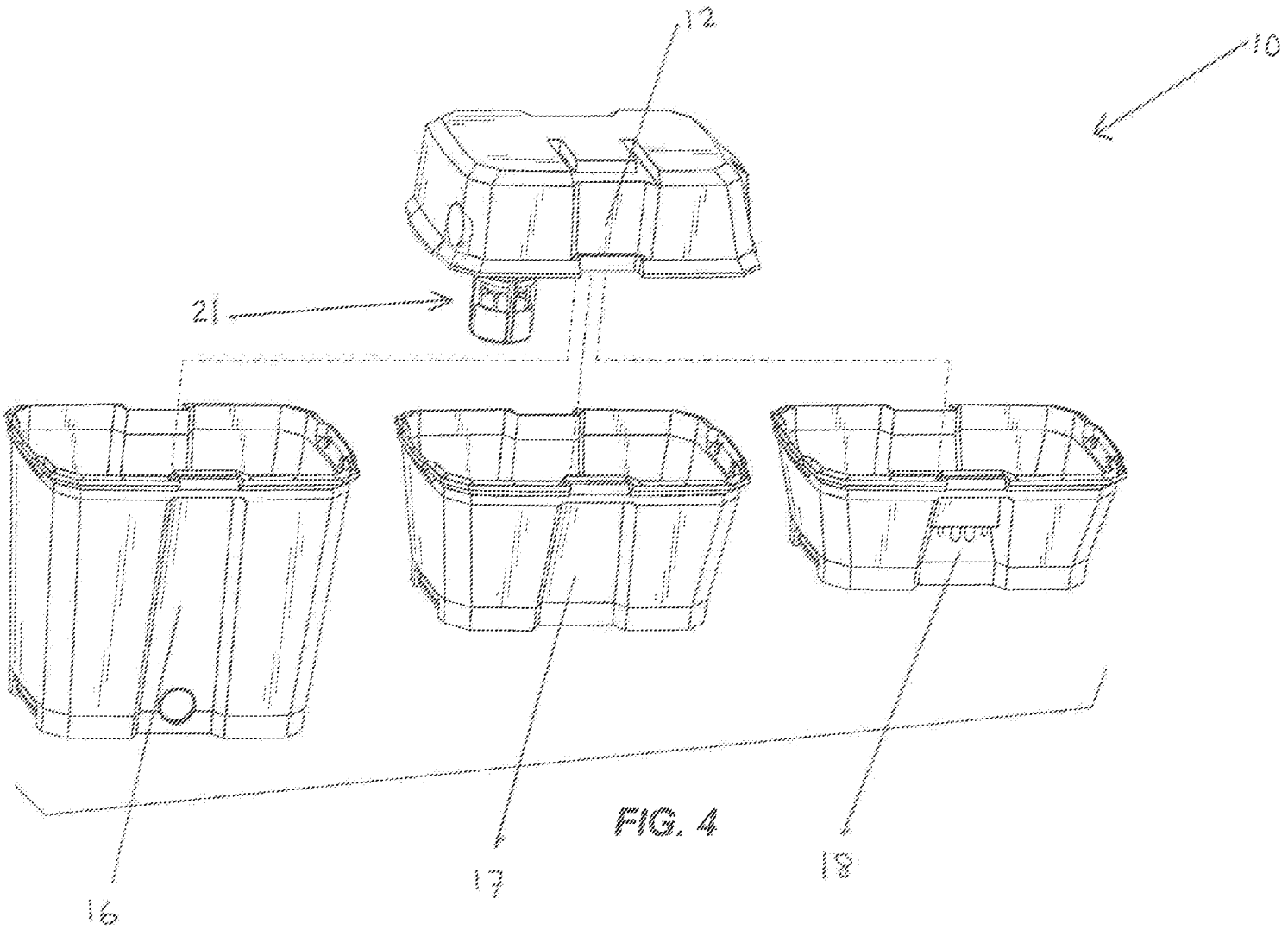
FIG. 4 illustrates a variety of canisters with mating cross-sections corresponding to a mating cross-section of the power head.

As shown in the FIGS. 4 and 5, the canisters 16, 17, 18 have multiple canister sizes. In the illustrated, embodiment, the first canister 16 has a capacity ranging from two gallons to six gallons. The second canister 17 has a capacity ranging seven gallons to sixteen gallons. In other embodiments the canisters 16, 17, 18 may have capacities ranging from two gallons to twenty gallons. The canisters 16, 17, 18 have an open upper end 27 and a closed lower end 28. FIG. 5 illustrates the first canister 16 with a first height 30 measured from the open upper end 27 to the closed lower end 28. The second canister 17 has a second height 31 and the third canister 18 has a third height 32. The shape of the open upper end 27 has a first polygonal cross-section 33 and the shape of the closed lower end 28 has a second polygonal cross-section 34. The size and shape of the open upper end 27 and closed lower end 28 are consistent across the canisters 16, 17, 18. Therefore, the capacity of each canister in the illustrated embodiments is varied by the heights 30, 31, 32 of the canisters 16, 17, 18. The canisters 16, 17, 18 can connect with the power heads 12, 14 at the open upper end 27, and they can connect to the base 20 at the closed lower end 28.

Figure 2:
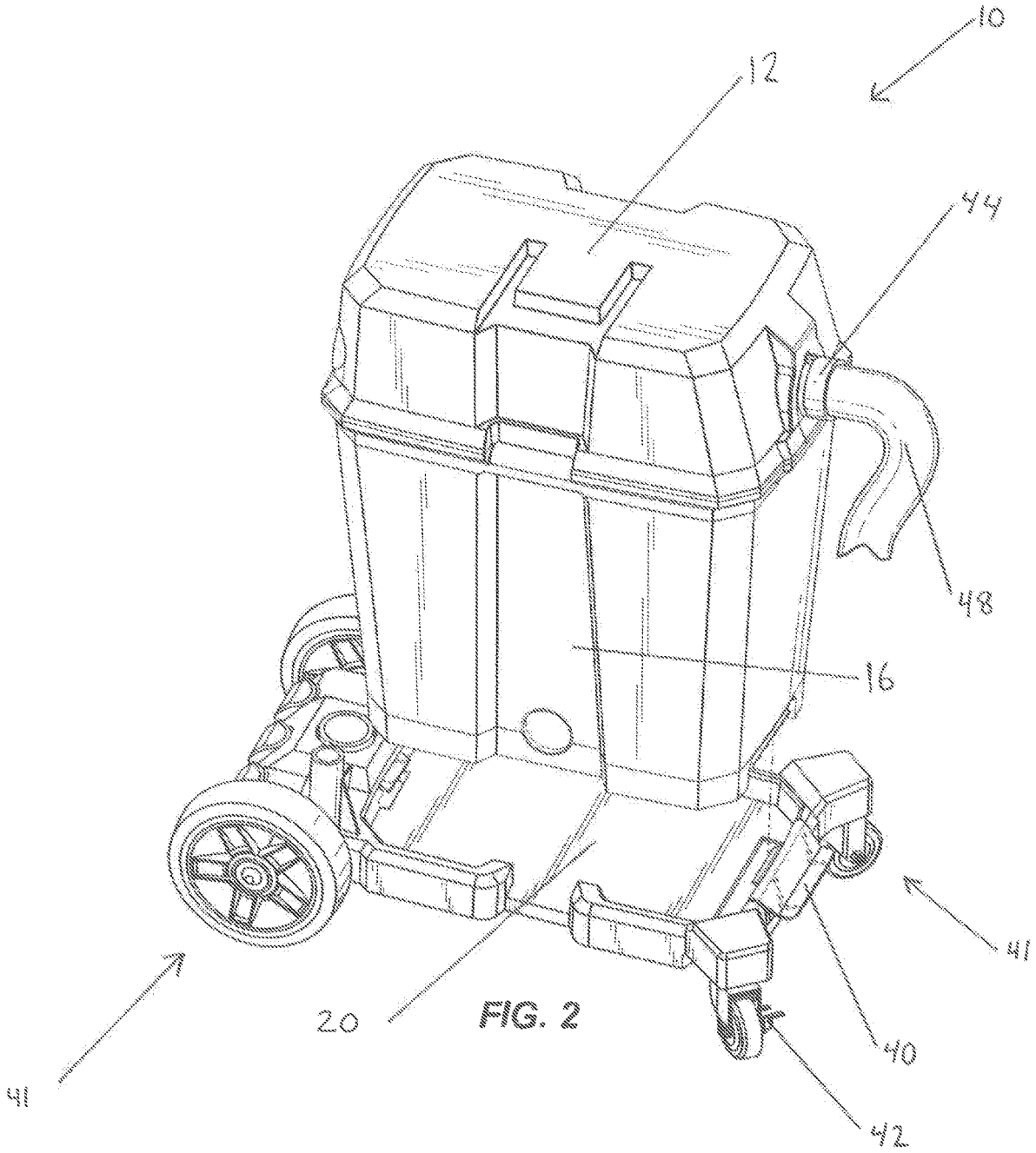
FIG. 2 is a perspective view of the modular vacuum system of FIG. 1 with a canister and a power head removed from a cart.

Referring to FIGS. 1 and 2, the base 20 includes a handle 38, a release 40, a wheels 41, and a brake 42. The release 40 is used for unlocking the canisters 16, 17, 18 from the base 20 (e.g., for emptying or for changing the canister or the base). In the illustrated embodiment, the handle 38 is an adjustable handle connected to the base 20 used to move the canisters 16, 17, 18 when they are attached to the base 20. The release 40 is a release lever actuated to remove the canisters 16, 17, 18 from the base 20. In one embodiment, the release 40 may be foot actuated release lever. In the illustrated embodiment, the brake 42 prevents the base 20 from moving by locking at least one of the wheels 41.

Figure 3:
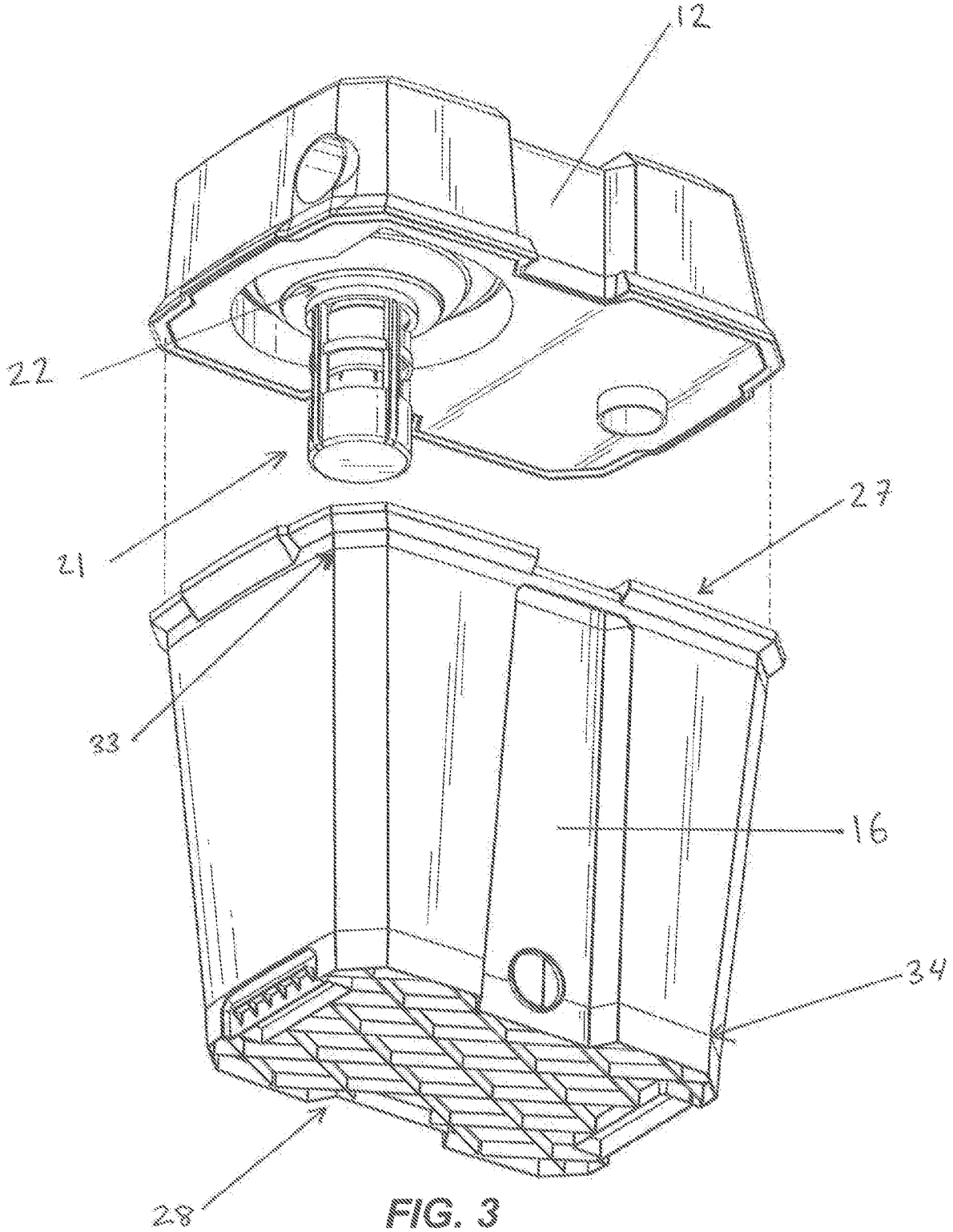
FIG. 3 is a perspective view of the power head removed from the canister.

Referring to FIGS. 3-5, the canisters 16, 17, 18 can stand freely without the base 20. That is, the canisters 16, 17, 18 can be set on the ground, and the modular vacuum system 10 can be used without the base 20. In some embodiments, the canisters 16, 17, 18 may include integrated handle(s) for emptying.

In the illustrated embodiment of FIG. 2, the modular vacuum system 10 includes an inlet 44 attached to the first power head 12. A hose 48 is removably coupled to the inlet 44. During the operation of the modular vacuum system 10, the first motor 22 is operated at the first voltage to generate a first suction airflow through the inlet 44. The first suction airflow collects debris that passes through the inlet 44. The debris is separated from the first suction airflow and stored in the canisters 16, 17, 18. In one embodiment, the inlet 44 may be attached to the second power head 14. In that embodiment, the second motor 24 generates a second suction airflow through the inlet 44, where the second suction airflow collects debris, and the debris is separated from the second suction airflow and deposited in the canisters 16, 17, 18. FIG. 5 illustrates the modularity of the modular vacuum system 10 illustrates the canisters 16, 17, 18 coupled to the power heads 12, 14 such that the canisters 16, 17, 18 may receive the first or second suction airflow generated by the power heads 12, 14. In yet another embodiment, the inlet 44 may be attached the canisters 16, 17, 18.

What is claimed is:

1. A modular vacuum system comprising:

a first canister configured to store debris, the first canister having a first capacity;

a second canister configured to store debris, the second canister having a second capacity greater than the first capacity;

a first power head that can be coupled to either the first canister or the second canister, the first power head operable at a first voltage to generate a first suction airflow, the first power head can be coupled to the first canister such that the first canister receives the first suction airflow and the first canister stores debris separated from the first suction airflow, and the first power head can be coupled to the second canister such that the second canister receives the first suction airflow and the second canister stores debris separated from the first suction airflow; and a second power head that can be coupled to either the first canister or the second canister, the second power head operable at a second voltage, greater than the first voltage, to generate a second suction airflow, the second power head can be coupled to the first canister such that the first canister receives the second suction airflow and the first canister stores debris separated from the second suction airflow and the second power head can be coupled to the second canister such that the second canister receives the second suction airflow and the second canister stores debris separated from the second suction airflow;

wherein the first power head is battery powered at the first voltage but not the second voltage; and wherein the second power head is battery powered at the second voltage but not the first voltage.

2. The first and second canister of claim 1, wherein the first canister has a first height and the second canister has a second height greater than the first height.

3. The first and second canister of claim 2, wherein the first canister includes an open upper end and a closed lower end, the first height measured from the open upper end to the closed lower end, wherein the second canister includes an open upper end and a closed lower end, the second height measured from the open upper end of the second canister to the closed lower end of the second canister.

4. The first and second canister of claim 1, wherein the first canister includes an open upper end and the second canister includes an open upper end, wherein the open upper end of the first canister has the same size and shape as the open upper end of the second canister.

5. The first and second canister of claim 4, wherein the open upper end of the first canister has a first perimeter, wherein the open upper end of the second canister has a second perimeter equal to the first perimeter.

6. The first and second canister of claim 5, wherein the first and second perimeter have a polygonal cross-section.

7. The first and second canister of claim 1, wherein the first capacity is in a range from 2 gallons to 6 gallons, wherein the second capacity is in the range from 7 gallons to 16 gallons.

8. The first and second power head of claim 1, wherein the first power head includes a first motor operable at the first voltage to generate the first suction airflow, wherein the second power head includes a second motor operable at the second voltage to generate the second suction airflow.

9. The first and second suction airflow of claim 8, wherein the first suction airflow draws debris through the first power head and disposes debris into the first canister, wherein the second suction airflow draws debris through the second power head and disposes debris into the second canister.

10. A modular vacuum system comprising: a first canister configured to store debris, the first canister having a first capacity; a second canister configured to store debris, the second canister having a second capacity greater than the first capacity; a plurality of power heads that can each be coupled to either the first canister or the second canister, each power head of the plurality of power heads operable to generate a suction airflow, each power head of the plurality of power heads can be coupled to the first canister such that the first canister receives the suction airflow and the first canister stores debris separated from the suction airflow, and each power head of the plurality of power heads can be coupled to the second canister having a greater capacity than the first canister, such that the second canister receives the suction airflow and the second canister stores debris separated from the suction airflow; wherein each power head of the plurality of power heads is battery powered and operable at one of a plurality of respective performance levels; and wherein each power head of the plurality of power heads is operable only at their respective performance level.

11. The first and second canister of claim 10, wherein the first canister has a first height and the second canister has a second height greater than the first height.

12. The first and second canister of claim 11, wherein the first canister includes an open upper end and a closed lower end, the first height measured from the open upper end to the closed lower end, wherein the second canister includes an open upper end and a closed lower end, the second height measured from the open upper end of the second canister to the closed lower end of the second canister.

13. The first and second canister of claim 10, wherein the first canister includes an open upper end and the second canister includes an open upper end, wherein the open upper end of the first canister has the same size and shape as the open upper end of the second canister.

14. The first and second canister of claim 13, wherein the open upper end of the first canister has a first perimeter, wherein the open upper end of the second canister has a second perimeter equal to the first perimeter.

15. The first and second canister of claim 14, wherein the first and second perimeter have a polygonal cross-section.

16. The first and second canister of claim 10, wherein the first capacity is in a range from 2 gallons to 6 gallons, wherein the second capacity is in the range from 7 gallons to 16 gallons.

17. The modular vacuum system of claim 10, wherein each power head of the plurality of power heads includes a motor operable at a voltage that corresponds to the respective performance level of the corresponding power head to generate the suction airflow.

18. The modular vacuum system of claim 17, wherein for a first power head of the plurality of power heads, the suction airflow draws debris through the first power head and disposes debris into the first canister.

19. The modular vacuum system of claim 18, wherein for a second power head of the plurality of power heads, the suction airflow draws debris through the second power head and disposes debris into the second canister.

20. A modular vacuum system comprising:

a plurality of canisters, at least one canister in the plurality of canisters having a first capacity and at least another canister in the plurality of canisters having a second capacity different than the first capacity; and a plurality of power heads, at least one power head of the plurality of power heads operable at a first voltage supplied by a battery power source and at least another power head of the plurality of power heads operable at a second voltage supplied by a battery power source, the second voltage being different than the first voltage;

wherein each canister of the plurality of canisters can be selectively coupled to each power head of the plurality of power heads; and wherein each power head of the plurality of power heads is configured to operate at the first voltage or the second voltage but not both the first voltage and the second voltage.

* * * * *